US007343109B2

(12) United States Patent
Nishimura

(10) Patent No.: US 7,343,109 B2
(45) Date of Patent: Mar. 11, 2008

(54) ELECTROPHOTOGRAPHIC PRINTER HAVING DEVELOPER AND TRANSFER BIAS CONTROL

(75) Inventor: Soichiro Nishimura, Handa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 167 days.

(21) Appl. No.: 10/949,382

(22) Filed: Sep. 27, 2004

(65) Prior Publication Data

US 2005/0074249 A1 Apr. 7, 2005

(30) Foreign Application Priority Data

Oct. 2, 2003 (JP) ..... 2003-344652

(51) Int. Cl.
*G03G 15/00* (2006.01)

(52) U.S. Cl. ..... 399/43; 399/55; 399/66

(58) Field of Classification Search ..... 399/43, 399/46, 55, 66, 71
See application file for complete search history.

(56) References Cited

U.S. PATENT DOCUMENTS

| | | | | |
|---|---|---|---|---|
| 3,575,505 | A * | 4/1971 | Parmigiani | 399/43 |
| 4,592,646 | A * | 6/1986 | Suzuki et al. | 399/43 |
| 5,036,360 | A * | 7/1991 | Paxon et al. | 399/46 |
| 5,057,867 | A * | 10/1991 | Ishigaki et al. | 399/43 |
| 5,749,019 | A * | 5/1998 | Mestha | 399/46 |
| 5,774,762 | A * | 6/1998 | Takemoto et al. | 399/50 |
| 5,887,220 | A | 3/1999 | Nagaoka | |
| 6,175,375 | B1 * | 1/2001 | Able et al. | 347/132 |
| 6,647,229 | B2 * | 11/2003 | Haraguchi et al. | 399/149 |
| 6,785,482 | B2 * | 8/2004 | Ogata et al. | 399/55 |

FOREIGN PATENT DOCUMENTS

| | | | |
|---|---|---|---|
| JP | A 5-158357 | | 6/1993 |
| JP | 08095453 A | * | 4/1996 |
| JP | A 10-282812 | | 10/1998 |
| JP | A 11-258920 | | 9/1999 |
| JP | A 2000-75687 | | 3/2000 |
| JP | A 2000-330401 | | 11/2000 |

(Continued)

*Primary Examiner*—Robert Beatty
(74) *Attorney, Agent, or Firm*—Oliff & Berridge, PLC

(57) ABSTRACT

An image forming apparatus including: a developing device that develops an electrostatic latent image formed on an image bearing body into a visible image by using a charged developer, so as to form a developer image on the image bearing body; a developing-bias supplying device that supplies, to the developing device, a developing bias necessary for developing the electrostatic latent image into the visible image; a transfer device that transfers the developer image formed on the image bearing body onto a recording medium; a transfer-bias supplying device that supplies, to the transfer device, a transfer bias necessary for transferring the developer image onto the recording medium; and a controller that carries out at least one of (A) developing-bias-dependent transfer-bias control for controlling the transfer bias supplied by the transfer-bias supplying device to the transfer device, on the basis of the developing bias supplied by the developing-bias supplying device to the developing device, and (B) operation-amount-dependent developing-and-transfer-bias control for controlling the developing bias supplied by the developing-bias supplying device to the developing device and the transfer bias supplied by the transfer-bias supplying device to the transfer device, on the basis of an operation amount of the image forming apparatus.

19 Claims, 6 Drawing Sheets

FOREIGN PATENT DOCUMENTS

| | | | |
|---|---|---|---|
| JP | A 2001-13836 | | 1/2001 |
| JP | B2 3172557 | | 3/2001 |
| JP | B2 3270857 | | 1/2002 |
| JP | B2 3313219 | | 5/2002 |
| JP | 2002244369 A | * | 8/2002 |

* cited by examiner

FIG.3

(CONTROL TABLE 105)

| NUMBER OF PRINTED PAPER SHEETS | DEVELOPING-BIAS VOLTAGE | TRANSFER CURRENT | BRUSH VOLTAGE |
|---|---|---|---|
| 0～1500 | 400V | −16 μA | 330V |
| 1501～3000 | 375V | −15 μA | 370V |
| 3001～4500 | 350V | −14 μA | 410V |
| 4501～6000 | 325V | −13 μA | 450V |
| 6001～ | 300V | −12 μA | 490V |
| ・・・・・ | ・・・・・ | ・・・・・ | ・・・・・ |

ELECTROPHOTOGRAPHIC PRINTER HAVING DEVELOPER AND TRANSFER BIAS CONTROL

The present application is based on Japanese Patent Application No. 2003-344652 filed Oct. 2, 2003, the contents of which are incorporated herein by reference.

BACKGROUND OF THE INVENTION

1. Field of the Invention

The present invention relates in general to an image forming apparatus which forms a developer image on an image bearing body by developing, with a charged developer, an electrostatic latent image formed on the image bearing body into a visible image, and transfers the developer image to a recording medium.

2. Discussion of Related Art

As an image forming apparatus, an electrophotographic printer is conventionally known. In this type of image forming apparatus, a photosensitive body as an image bearing or carrying body is exposed to a light to form an electrostatic latent image on the photosensitive body, and a charged developer or developing agent such as toner is applied to the photosensitive body to thereby develop the electrostatic latent image into a visible image, so that a developer image as the visible image is formed on the photosensitive body.

In applying the developer to the photosensitive body, a developing bias is supplied to a developer bearing or carrying body (such as a developing roller) of a developing device which is held in abutting contact with the photosensitive body, so as to form, between the developer bearing body and the photosensitive body, an electric field in a direction in which the developer moves toward the photosensitive body, whereby the developer is applied to the photosensitive body. Thereafter, a recording paper as a recording medium is fed between the photosensitive body and a transfer body such as a transfer roller which is disposed so as to be opposed to the photosensitive body, and a transfer bias is supplied to the transfer body, so as to form, between the transfer body and the photosensitive body, an electric field in a direction in which the developer moves toward the recording paper, so that the developer image on the photosensitive body is transferred to the recording paper.

In the thus arranged image forming apparatus, it is general that the charge amount of the developer, in detail, for instance, charge-to-mass ratio of the developer represented by the charge amount of the developer per unit mass gradually changes as the printing operation is repeated. When the charge amount changes, the optimum value of the transfer bias to be supplied to the transfer body for the transfer of the developer image from the photosensitive body to the recording paper changes. In view of this, the transfer bias value (current value or voltage value) to be supplied to the transfer body is controlled depending upon a number of printed sheets of paper, as disclosed in JP-A-5-158357, for instance.

SUMMARY OF THE INVENTION

However, the change of the charge amount of the developer influences not only the transferring process by the transfer body, but also the developing process by the developing device. Accordingly, it is difficult to prevent quality deterioration of the printed image to a sufficient extent by only controlling the transfer bias value depending upon the number of printed paper sheets.

It is therefore a first object of the present invention to provide an image forming apparatus in which the quality of the printed image is sufficiently prevented from being deteriorated due to an influence of the change in the charge amount of the developer, to thereby form a high-quality image on a recording medium with high stability.

It is a second object of the present invention to provide an image forming apparatus which is capable of stably forming a high-quality image on a recording medium with reduced power consumption.

The objects indicated above may be achieved according to a principle of the present invention, which provides an image forming apparatus comprising: a developing device that develops an electrostatic latent image formed on an image bearing body into a visible image by using a charged developer, so as to form a developer image on the image bearing body; a developing-bias supplying device that supplies, to the developing device, a developing bias necessary for developing the electrostatic latent image into the visible image; a transfer device that transfers the developer image formed on the image bearing body onto a recording medium; a transfer-bias supplying device that supplies, to the transfer device, a transfer bias necessary for transferring the developer image onto the recording medium; and a controller that carries out at least one of (A) developing-bias-dependent transfer-bias control for controlling the transfer bias supplied by the transfer-bias supplying device to the transfer device, on the basis of the developing bias supplied by the developing-bias supplying device to the developing device, and (B) operation-amount-dependent developing-and-transfer-bias control for controlling the developing bias supplied by the developing-bias supplying device to the developing device and the transfer bias supplied by the transfer-bias supplying device to the transfer device, on the basis of an operation amount of the image forming apparatus.

It is noted that the optimum value of the transfer bias changes in response to the developing bias value. In the present image forming apparatus constructed as described above, where the controller is arranged to carry out the above-indicated developing-bias-dependent transfer-bias control, the transfer bias to be supplied to the transfer device can be changed to a suitable value on the basis of the developing bias value, so that the image transfer can be efficiently carried out by the transfer device. Accordingly, the present image forming apparatus is capable of forming a high-quality image on the recording medium with high stability.

In the present image forming apparatus, where the controller is arranged to carry out the operation-amount-dependent developing-and-transfer-bias control, the developing bias to be supplied to the developing device and the transfer bias to be supplied to the transfer device can be adjusted on the basis of the operation amount of the apparatus, so that it is possible to prevent, to a sufficient extent, the results of the image development and image transfer from being changed due to the change in the charge-to-mass ratio of the developer. Thus, the image forming apparatus can form a high-quality image on the recording medium with high stability, irrespective of the change in the chare-to-mass ratio of the developer.

In the present image forming apparatus constructed as described above, the developing-bias supplying device may be arranged to supply a suitable developing bias (i.e., developing bias voltage) to the developing device by performing a constant-voltage control, so as to establish a target voltage value determined by the controller. Similarly, the transfer-bias supplying device may be arranged to supply a suitable transfer bias (i.e., transfer bias voltage) to the transfer device by performing a constant-voltage control, so as to establish a target voltage value determined by the controller, or to supply a suitable transfer bias (i.e., transfer current) to the transfer device by performing a constant-current control, so as to establish a target current value determined by the controller.

The operation amount of the image forming apparatus which is used when the controller of the apparatus carries out the operation-amount-dependent developing-and-transfer-bias control may be a number of printed sheets of paper (i.e., a number of printed paper sheets), an operation time during which the image forming apparatus is operated, or an operation amount of the developing device, for instance.

Where the controller of the image forming apparatus carries out the operation-amount-dependent developing-and-transfer-bias control, the controller may be arranged to determine the developing bias on the basis of the operation amount and obtain an optimum value of the transfer bias based on the determined developing bias by using arithmetic expression(s). The controller may be arranged to determine the developing bias otherwise. For instance, there is initially prepared, on the basis of results of tests or experiments, etc., a table which indicates suitable values of the developing bias and the transfer bias determined for the operation amount of the apparatus. This table may be incorporated into the image forming apparatus and the controller may be arranged to determine, on the basis of the table, the developing bias value and the transfer bias value to be supplied to the developing-bias supplying device and the transfer-bias supplying device, respectively.

In the present image forming apparatus constructed as described above, the developing-bias supplying device may be arranged such that the developing bias which is supplied to the developing device is variable. In this arrangement, the developing bias can be changed in response to or on the basis of the charge-to-mass ratio of the developer. This arrangement is effective, for instance, to prevent an increase in the amount of the developer which adheres to the image bearing body due to a decrease of the charge-to-mass ratio, whereby the quality of the printed image such as the concentration can be kept constant irrespective of the operation amount of the image forming apparatus.

When the controller of the present image forming apparatus carries out the operation-amount-dependent developing-and-transfer-bias control, the apparatus may be arranged to further comprise an operation-amount measuring device. Where the present image forming apparatus is arranged to comprise the operation-amount measuring device, the operation amount of the apparatus represented by those described above may be obtained by the measuring device.

In the present image forming apparatus constructed as described above, the controller may be arranged such that the developing bias supplied by the developing-bias supplying device to the developing device decreases with an increase in the operation amount of the image forming apparatus.

In the developing method utilizing the electric force, the developer whose charge-to-mass ratio is relatively large is used for the image development earlier than the developer whose charge-to-mass ratio is relatively small. Accordingly, the developer whose charge-to-mass ratio is relatively small tends to remain in a developer accommodating chamber of the developing device without being used for the image development. Accordingly, the charge-to-mass ratio of the developer used for the image development by the developing device becomes small with an increase in the operation amount of the image forming apparatus. If the developing bias is kept constant irrespective of the change in the operation amount, the amount of the developer which adheres to the image bearing body increases with an increase in the operation amount, in other words, with a decrease in the charge-to-mass ratio of the developer, inevitably increasing the concentration of the printed image.

In the image forming apparatus wherein the developing bias is controlled by the controller to decrease with an increase in the operation amount of the apparatus as described above, the amount of the developer which adheres to the image bearing body can be kept constant irrespective of the increase in the operation amount, thereby preventing the concentration of the printed image from being increased.

In the image forming apparatus of the present invention, the controller may be arranged such that the transfer bias supplied by the transfer-bias supplying device to the transfer device decreases with a decrease in the developing bias.

When the developing bias becomes smaller, the total charge amount of the developer which moves from the developing device to the image bearing body becomes smaller. If the same transfer bias as that supplied before the developing bias becomes smaller is kept supplied to the transfer device in spite of the decrease in the developing bias, the transfer bias supplied to the transfer device is larger than necessary. In this case, the deterioration of the transfer device is accelerated, resulting in a shortened life time of the transfer device. Further, the electric power is wastefully consumed.

Where the transfer bias supplied to the transfer device is arranged to decrease with a decrease in the developing device as described above, it is possible to prevent an excessive transfer bias from being supplied to the transfer device, so that the developer image on the image bearing body can be efficiently transferred to the recording medium. Accordingly, this arrangement effectively prevents the deterioration of the transfer device and reduces the electric power required for the image transfer.

Where the present image forming apparatus employs a so-called cleaner-less system, in other words, the present apparatus is arranged such that the developer remaining on the image bearing body after the developer image has been transferred to the recording medium by the transfer device is collected by the developing device, the controller may be arranged to control the transfer bias supplied by the transfer-bias supplying device to the transfer device such that polarity of the developer adhering to the image bearing body is not reversed.

As well known, in the image transfer carried out by the transfer device, the entirety of the developer on the image bearing body can not be completely transferred to the recording medium, but a part of the developer remains on the image bearing body after the image transfer. In the image forming apparatus which employs the cleaner-less system, the developer remaining on the image bearing body after the transfer is collected by the developing device. In this case, if the polarity of a part of the developer was reversed during the image transfer, it would be difficult to collect, by the developing device, such a part of polarity-reversed developer.

In the image forming apparatus which is arranged to comprise the controller that controls the transfer bias such that the polarity of the developer adhering to the image bearing body is not reversed, the transfer bias is controlled to a suitable value which does not cause the reversal of polarity of the developer adhering to the image bearing body. Accordingly, the developer device effectively collects the developer remaining on the image bearing body. Therefore, the image forming apparatus according to this arrangement prevents lowering of the rate of collection or recovery of the developer.

In the present image forming apparatus, the transfer device may be an ion-conductive transfer roller that is arranged to transfer, upon receiving the transfer bias, the developer image formed on the image bearing body to the recoding medium passing between the image bearing body and transfer roller.

In general, the resistance of the ion-conductive transfer roller increases with an increase in a total amount of the current which flows in the ion-conductive roller, resulting in deterioration of the ion-conductive roller. Where such an ion-conductive roller is installed as the transfer device on the present image forming apparatus, the transfer bias which is suitably controlled on the basis of the developing bias is supplied to the supplying device (transfer roller), so as to prevent a wasteful current supply to the transfer roller, thereby avoiding the deterioration of the transfer roller.

Where the present image forming apparatus is arranged to transfer the developer image to a recording paper as the recording medium, the apparatus may further comprise: a paper-dust removing device that removes paper dust adhered to the image bearing body when the developer image is transferred to the recording medium by the transfer device; and a paper-dust-removing-voltage supplying device that supplies, to the paper-dust removing device, a voltage for removing the paper dust from the image bearing body. In this arrangement, the image forming apparatus may further comprise a paper-dust-removing-voltage changing device.

The paper-dust-removing-voltage changing device may be arranged to change the paper-dust-removing voltage supplied by the paper-dust-removing-voltage supplying device to the paper-dust removing device, on the basis of the transfer bias supplied by the transfer-bias supplying device to the transfer device.

When the transfer bias supplied to the transfer device changes, the surface potential of the unexposed portion of the image bearing body largely changes in response to the change of the transfer bias. In this case, the optimum voltage value to be applied to the paper-dust removing device for removal of the paper dust from the image bearing body is changed. If the voltage of the paper-dust-removing device is kept constant irrespective of the change in the transfer bias value, the paper-dust removal capability of the paper-dust removing device is undesirably lowered.

In the image forming apparatus in which the paper-dust-removing-voltage changing device changes, on the basis of the transfer bias, the voltage to be supplied by the paper-dust-removing-voltage supplying device to the paper-dust removing device, the paper-dust removal capability of the paper-dust removing device is prevented from being lowered. In addition, since this arrangement prevents supply of an excessive voltage to the paper-dust removing device, the power consumption of the image forming apparatus can be reduced.

The paper-dust removing device may comprise any one of a brush and a non-woven fabric both of which have an electrical conductivity. The electrically conductive brush or no-woven fabric attracts, upon receiving the voltage from the paper-dust-removing-voltage supplying device, the paper dust adhering to the image bearing body, so that the paper-dust removing function can be realized with a simplified arrangement.

Where the image forming apparatus comprises the paper-dust removing device, the developer is preferably a positively charged toner. In general, the paper dust is negatively charged. If the developer is the positively charged toner, only the paper dust can be selectively removed from the image bearing body by the paper-dust removing device such as the brush. Accordingly, the toner can be collected efficiently by the developing device without being collected by the paper-dust removing device such as the brush.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which:

FIG. 3 is a view showing a structure of a control table;

DETAILED DESCRIPTION OF THE PREFERRED EMBODIMENTS

Figure 1:
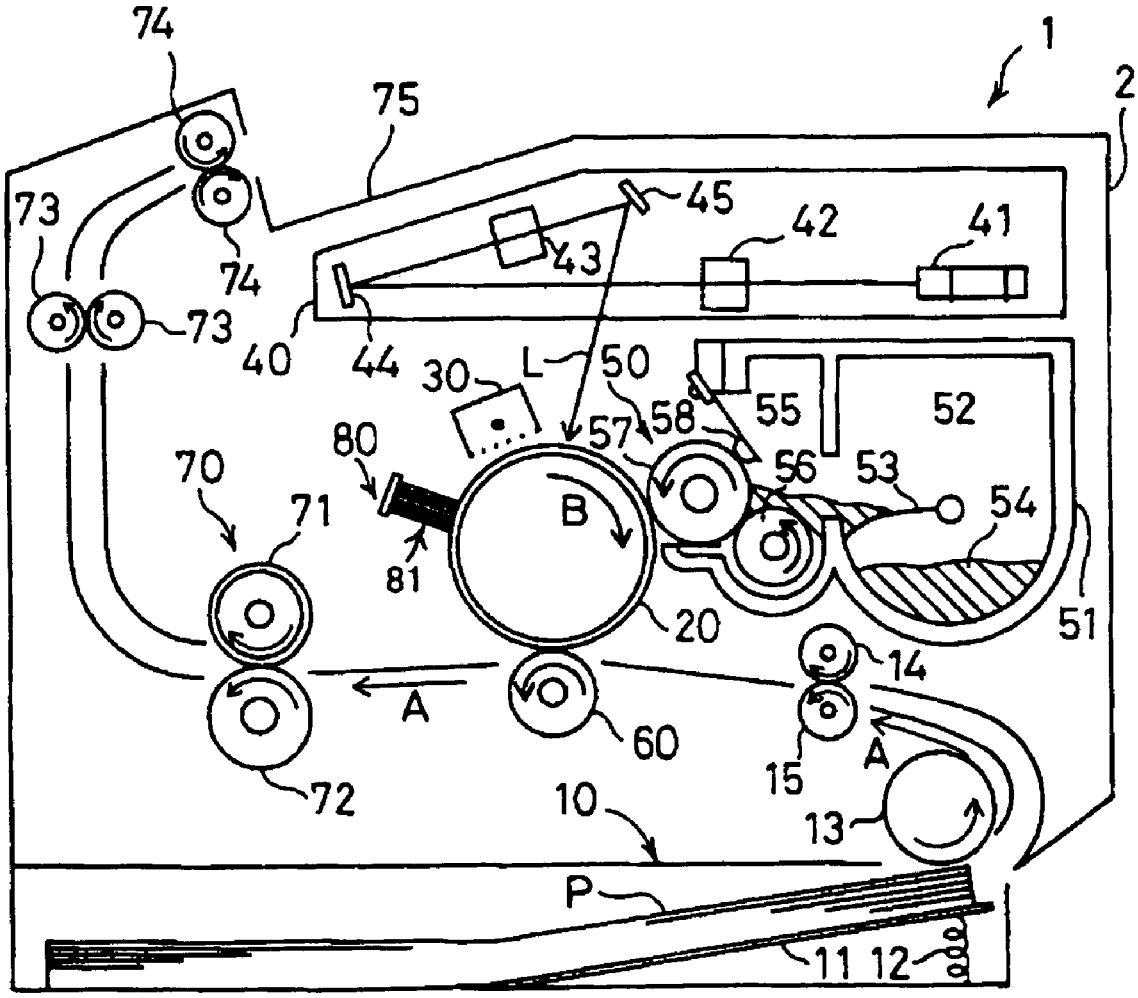
FIG. 1 is a schematic cross-sectional view of a laser printer according to which the present invention is applied.

Referring to the drawings, there will be described a preferred embodiment of the present invention.

Referring first to FIG. 1, there is shown an electrophotographic type image forming apparatus in the form of a laser printer indicated at 1 to which the present invention is applied. The laser printer 1 includes a main body casing 2 and a sheet feed unit 10 which is disposed at the bottom of the main body casing 2 and which feeds sheets of recording paper P as the recording media. The sheet feed unit 10 includes a sheet pressing plate 11, a compression spring 12, and a sheet supply roller 13. The sheets of recording paper P stacked on the sheet pressing plate 11 are pressed against the sheet supply roller 13 under the biasing force of the compression spring 12, and an uppermost sheet P is separated from the stack of sheets on the pressing plate 11 by rotation of the sheet supply roller 13, so as to be fed to a pair of the resist rollers 14, 15.

The resist rollers 14, 15 are rotatably provided on the downstream side of the sheet supply roller 13 as seen in a sheet feeding direction indicated by an arrow "A" in FIG. 1. The recording paper sheet P is fed to a transfer position defined by and between a photosensitive drum 20 and a transfer roller 60 (which will be described) at a predetermined timing.

The photosensitive drum 20 as the image bearing body includes an organic photosensitive body whose major component is a positively chargeable material such as a positively chargeable polycarbonate. The photosensitive drum 20 is in the form of a hollow drum, for instance, which includes a sleeve as a main body having a cylindrical shape and formed of aluminum, and a photoconductive layer formed on the outer peripheral surface of the sleeve. The photoconductive layer is made of polycarbonate dispersed with photoconductive resin and has a predetermined thickness. The photosensitive drum 20 is rotatably mounted in the main body casing 2 with the sleeve being grounded. The photosensitive drum 20 is rotated in a direction indicated by an arrow "B" in FIG. 1 upon receiving a drive force from a drive source such as a motor via gears.

Around the periphery of the photosensitive drum 20, there are disposed a charger 30 for uniformly charging the surface of the photosensitive drum 20, a scanner unit 40 for irradiating the photosensitive drum 20 charged by the charger 30 with a laser beam L so as to form an electrostatic latent image, a developing unit 50 which forms a toner image as a developer image on the photosensitive drum 20 by developing, with a toner as a developer, the electrostatic latent image formed on the photosensitive drum 20 by the scanner unit 40, a transfer roller 60 which transfers the toner image formed on the photosensitive drum 20 to the sheet P, and a cleaning device 80 which is equipped with a cleaning brush 81 for removing, from the photosensitive drum 20, paper dust adhered to the drum 20 during the image transfer.

The charger 30 is disposed so as to be opposed to the photosensitive drum 20 with a predetermined spacing therebetween. The charger 30 is, for instance, a positively charging, scorotron-type charger which generates corona discharge from a charge wire formed of tungsten, for instance.

The scanner unit 40 includes a laser generator (not shown) which generates a laser beam L for forming the electrostatic latent image on the photosensitive drum 20, polygon mirror 41 which is driven to rotate, lenses 42, 42, and reflection mirrors 44, 45. The laser scanner unit 40 irradiates the surface of the photosensitive drum 20 with the laser beam L, so that the photosensitive drum 20 is exposed at an exposure position located on the downstream side of the charger 30 as seen in the rotating direction "B" of the photosensitive drum 20, to thereby form an electrostatic latent image on the surface of the photosensitive drum 20.

The developing unit 50 includes a developing roller 57 functioning as the developing device which is held in abutting contact with the photosensitive drum 20 on the downstream side of the above-described exposure position as seen in the rotating direction "B" of the drum 20. The developing roller 57 develops, with a positively charged toner carried thereon, the electrostatic latent image formed on the photosensitive drum 20 by the scanner unit 40 into a visible image, to thereby form the toner image as the developer image on the photosensitive drum 20.

Described more specifically, the developing unit 50 includes a main body 51 and a toner accommodating chamber 52 provided in the main body 51. Within the toner accommodating chamber 52, there are provided an agitator 53 and a positively chargeable toner 54 (in detail, a polymerized toner). A developing chamber 55 is formed adjacent to the toner accommodating chamber 52. Within the developing chamber 55, a toner supply roller 56 and the developing roller 57 are rotatably supported.

The toner supply roller 56 has a metallic roller shaft covered with a roller portion that is formed of an electrically conductive foam material. The developing roller 57 has a roller body formed of electrically conductive urethane rubber or silicone rubber containing fine carbon particles, an outer surface of the roller body being coated with a coating layer formed of urethane rubber or silicone rubber containing fluorine. The toner supply roller 56 and the developing roller 57 are held in pressing contact with each other.

The toner 54 in the toner accommodating chamber 52 is agitated by rotation of the agitator 53 and is supplied to the developing chamber 55, so that the toner 54 is positively charged by friction between the toner supply roller 56 and the developing roller 57, and is carried on the developing roller 57.

The toner 54 carried on the developing roller 57 is formed into a layer whose thickness is regulated into a predetermined value by a layer-thickness regulating blade 58 and is used for the image development. The layer-thickness regulating blade 58 has a plate spring formed of stainless steel, for instance, and a pressing portion disposed at a distal portion of the plate spring and formed of rubber such as silicone rubber. The pressing portion is pressed against the developing roller 57 by the elastic force of the plate spring. To the developing roller 57, there is supplied, by a developing-bias supplying portion 111 which will be described, a developing bias necessary for forming the electrostatic latent image into a visible image, in other words, necessary for applying the toner to the photosensitive drum 20.

The transfer roller 60 functioning as the transfer device has a shaft whose surface is coated with a foamed elastic body such as polyurethane having ion conductivity and a circular cross sectional shape. The transfer roller 60 is rotatably supported with the surface of the foamed elastic body being held in abutting contact with the surface of the photosensitive drum 20. The transfer roller 60 is rotated in rolling contact with the photosensitive drum 20 upon receiving a drive force (friction force) from the drum 20 in the contacting surface with the drum 20.

The foamed elastic body is a high molecular foamed body in which an ion conductive agent(s) is contained so that its electric resistance value is adjusted to a predetermined value. Examples of the ion conductive agent include inorganic ionic substances such as lithium perchlorate, sodium perchlorate, and calcium perchlorate, a cationic surfactant, an amphoteric surfactant, and an organic ionic substance such as tetraethylammonium perchlorate. In this kind of the foamed elastic body, the ions tend to be located non-uniformly due to the electric current flowing therethrough, resulting in an increase in the electric resistance, namely, causing deterioration.

The paper sheet P fed from the resist rollers 14, 15 is drawn between the photosensitive drum 20 and the transfer roller 60, and is passed toward a fixing unit 70 which will be described. While the paper sheet P is passing between the transfer roller 60 and the photosensitive drum 20, a transfer bias in a forward direction which is necessary for the image transfer is supplied to the transfer roller 60 from a transfer-forward-bias supplying portion 113 which will be described, so that the toner image on the photosensitive drum 20 is transferred to the sheet P.

Disposed downstream of the transfer position as seen in the sheet feeding direction "A" are the fixing unit 70 for fixing the toner image on the paper sheet P, a pair of transport rollers 73, 73 for transporting the paper sheet P, a pair of discharge rollers 74, 74, and a discharge tray 75.

The fixing unit 70 includes a heat roller 71 and a pressure roller 72. The toner image transferred to the paper sheet P is pressed between the rollers 71, 72 while being heated by the heat roller 71, whereby the toner image is thermally fixed to the paper sheet P. The transport rollers 73, 73 and the discharge rollers 74, 74 are disposed downstream of the fixing unit 70 as seen in the sheet feeding direction "A" and the discharge tray 75 is disposed downstream of the discharge rollers 74, 74 as seen in the sheet feeding direction "A".

The cleaning device 80 includes the electrically conductive cleaning brush 81 functioning as a paper-dust removing device. The brush 81 is formed of fiber such as nylon, acryl and rayon on which a conductive treatment has been performed. The cleaning device 80 is arranged to selectively remove, from the photosensitive drum 20, paper dust which has been negatively charged during the image transfer. Described more specifically, a suitable voltage (hereinafter referred to as "brush voltage") is applied to the cleaning brush 81 by a brush-voltage supplying portion 117 which will be described, such that the potential of the cleaning brush 81 is made higher than the surface potential of the photosensitive drum 20. According to this arrangement, the positively charged toner remaining on the photosensitive drum 20 is not attracted by the cleaning brush 81, but only the negatively charged paper dust is selectively attracted by the cleaning brush 81.

The laser printer 1 of the present embodiment is of a so-called cleaner-less type wherein the toner remaining on the photosensitive drum 20 after the image transfer is not collected by the cleaning device 80, but collected by the developing roller 57 of the developing unit 50.

Figure 2:
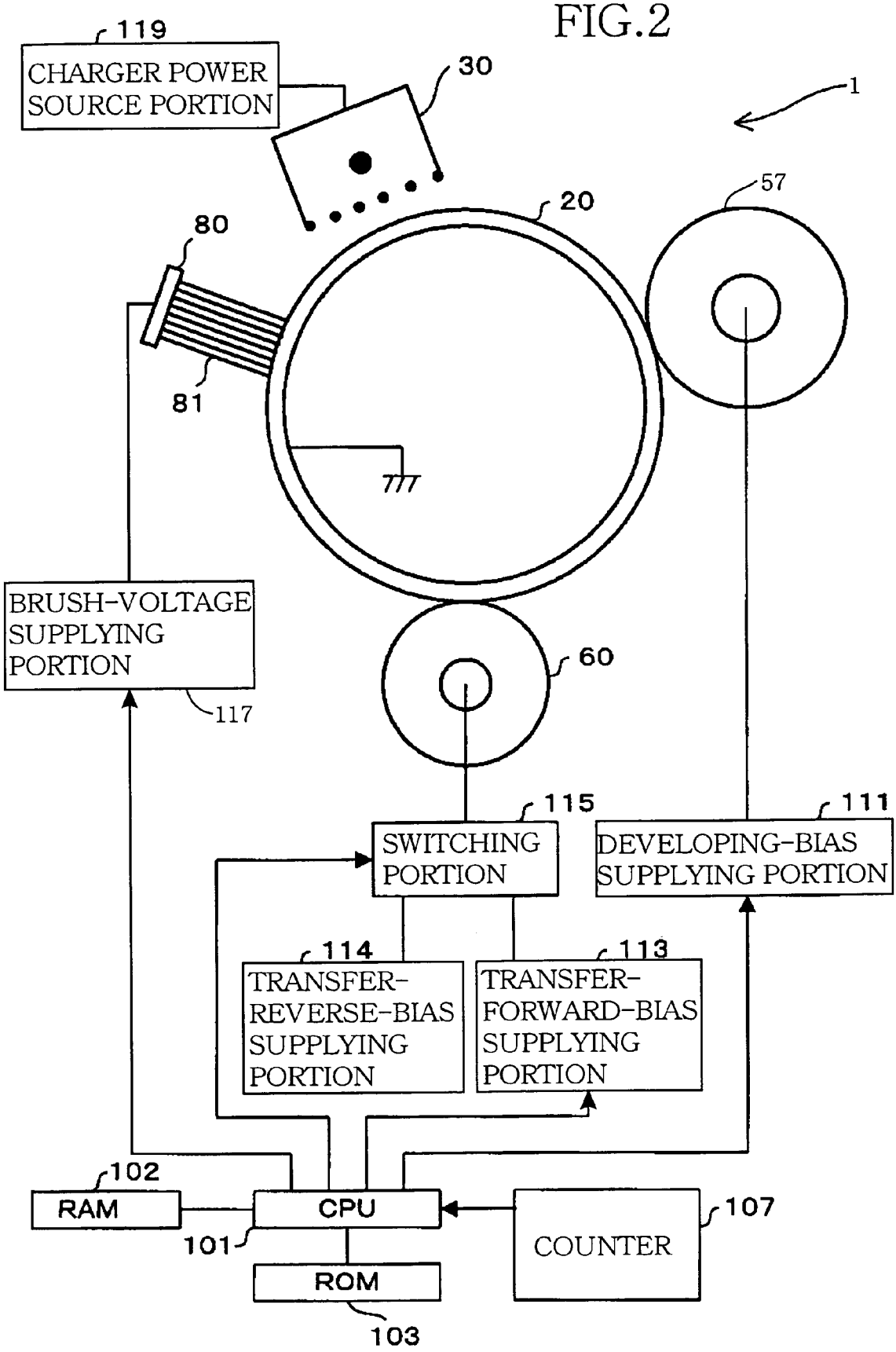
FIG. 2 is a block diagram showing an electric structure of the laser printer of FIG. 1.

By referring next to FIG. 2, there will be explained an electric structure of the laser printer 1. The laser printer 1 of the present embodiment includes a CPU 101 which controls the printer 1, a RAM 102 which temporarily stores various data necessary for the processing or operation executed by the CPU 101, and a ROM 103 which stores various programs and a control table 105 which will be described.

The laser printer 1 further includes a counter 107 which counts a number of printed paper sheets, i.e., a number of printing, the developing-bias-supplying portion 111, the transfer-forward-bias supplying portion 113, a transfer-reverse-bias supplying portion 114, a switching portion 115 which electrically connects one of the transfer-forward-bias supplying portion 113 and the transfer-reverse-bias supplying portion 114 to the transfer roller 60, the brush-voltage supplying portion 117, and a charger power source portion 119 which applies a predetermined high voltage to the charger 30.

The counter 107 is arranged to count or measure, as an operation amount of the printer 1, a number of paper sheets P printed by the printer 1 and functions as an operation-amount measuring device. The counter 107 is reset every time when a so-called process cartridge in which the transfer roller 60 and the developing roller 57 are arranged in a unit is replaced.

The CPU 101 obtains information representative of a number of printed paper sheets up to now from the counter 107, namely, reads a counted value of the counter 107, and controls the developing-bias-supplying portion 111, the transfer-forward-bias supplying portion 113, the brush-voltage supplying portion 117, etc. Further, when the toner image formed on the photosensitive drum 20 is transferred to the paper sheet P, the CPU 101 controls the switching portion 115 such that the transfer-forward-bias supplying portion 113 is connected to the transfer roller 60. When the toner adhering to the transfer roller 60 is collected by the developing roller 50 while being attracted to the photosensitive drum 20, the CPU 101 controls the switching portion 115 such that the transfer-reverse-bias supplying portion 114 is connected to the transfer roller 60.

The developing-bias supplying portion 111 functioning as the developing-bias supplying device is connected to the shaft of the developing roller 57. The developing-bias supplying portion 111 supplies, to the developing roller 57, a suitable developing bias (developing-bias voltage) under the constant-voltage control, so that the surface potential of the developing roller 57 is determined as the bias value supplied by the developing-bias supplying portion 111. The developing-bias supplying portion 111 has a constant-voltage power source of variable-voltage type and is arranged such that the developing bias (developing-bias voltage) supplied to the developing roller 57 is variable. The developing-bias supplying portion 111 supplies, to the developing roller 57, the developing bias corresponding to the developing-bias voltage value determined by the CPU 101 depending upon the number of printed paper sheets.

The transfer-forward-bias supplying portion 113 functioning as the transfer-bias supplying device has a constant-current power source of a so-called variable-current type which is connected to the input terminal of the switching portion 115. The transfer-forward-bias supplying portion 113 supplies under the constant-current control, to the transfer roller 60, the transfer bias in the forward direction (transfer current) corresponding to the transfer current value determined by the CPU 101.

By supplying the transfer bias in the forward direction to the transfer roller 60, the surface potential of the transfer roller 60 becomes lower than the surface potential of the photosensitive drum 20 immediately before the drum 20 contacts the transfer roller 60, so that the toner moves from the photosensitive drum 20 toward the paper sheet P passing between the photosensitive drum 20 and the transfer roller 60. Thus, the toner image on the photosensitive drum 20 is transferred to the paper sheet P. In this image transfer process, the negatively-charged paper dust of the paper sheet P adheres to the photosensitive drum 20.

The transfer-reverse-bias supplying portion 114 has a constant-voltage power source connected to the input terminal of the switching portion 115 and supplies, to the transfer roller 60, a transfer bias in the reverse direction which is opposite to the above-indicated forward direction, i.e., transfer bias of positive polarity, such that the surface potential of the transfer roller 60 becomes higher than the surface potential of the photosensitive drum 20 immediately before the drum 20 contacts the transfer roller 60. The output terminal of the switching portion 115 is connected to the shaft of the transfer roller 60.

The brush-voltage supplying portion 117 functioning as the paper-dust-removing-voltage supplying device has a constant-voltage power source of a so-called variable-voltage type and is connected to the cleaning brush 81 of the cleaning device 80. The brush-voltage supplying portion 117 applies, to the cleaning brush 81, the brush voltage corresponding to the brush-voltage value determined by the CPU 101 depending upon the number of printed paper sheets, so that the surface potential of the cleaning brush 81 becomes higher than the surface potential of the photosensitive drum 20.

Accordingly, the positively charged toner 54 remaining on the photosensitive drum 20 does not adhere to the cleaning brush 81, but only the negatively charged paper dust adheres to the cleaning brush 81. It is, however, noted that the toner 54 is negatively charged if an excessive transfer current is supplied to the transfer roller 60 during the image transfer. In the present embodiment, in a bias-determining operation (which will be described in detail) executed by the CPU 101, the control value of the transfer-forward-bias supplying portion 113 which is a bias value to be supplied by the transfer-forward-bias supplying portion 113 to the transfer roller 60 is determined, based on the control table 105, to be a transfer-current value which does not positively cause the toner 54 to be negatively charged in the image transfer.

FIG. 3 is a view for explaining the structure of the control table 105. The control table 105 is prepared in advance by the manufacturer based on results of tests or experiments, for instance, and is stored in the ROM 103. In the present embodiment, the control table 105 is prepared in the following manner: For changing the developing-bias voltage, the transfer current, and the brush voltage in steps so as to correspond to the number of printed paper sheets every time when the number of printed paper sheets exceeds any one of predetermined threshold values, the control table 105 of the present embodiment is prepared such that the control table 105 includes a plurality of sets of the developing-bias voltage value, the transfer current value, and the brush-voltage value, the plurality of sets being provided respectively for a plurality of ranges of the number of printed paper sheets (for every 1,500 sheets in the present embodiment). The developing-bias voltage value, the transfer current value, and the brush-voltage value in each set are to be determined by the CPU 101 as the control values of the developing-bias supplying portion 111, transfer-forward-bias supplying portion 112, and brush-voltage supplying portion 117, respectively, when the number of print paper sheets falls within the corresponding range. The thus prepared control table 105 is stored in the ROM 103. Described more specifically, the control table 105 is prepared such that, with an increase in the number of printed paper sheets, the absolute value of the developing-bias voltage and the absolute value of the transfer current decrease and the absolute value of the brush voltage increases.

Figure 4:
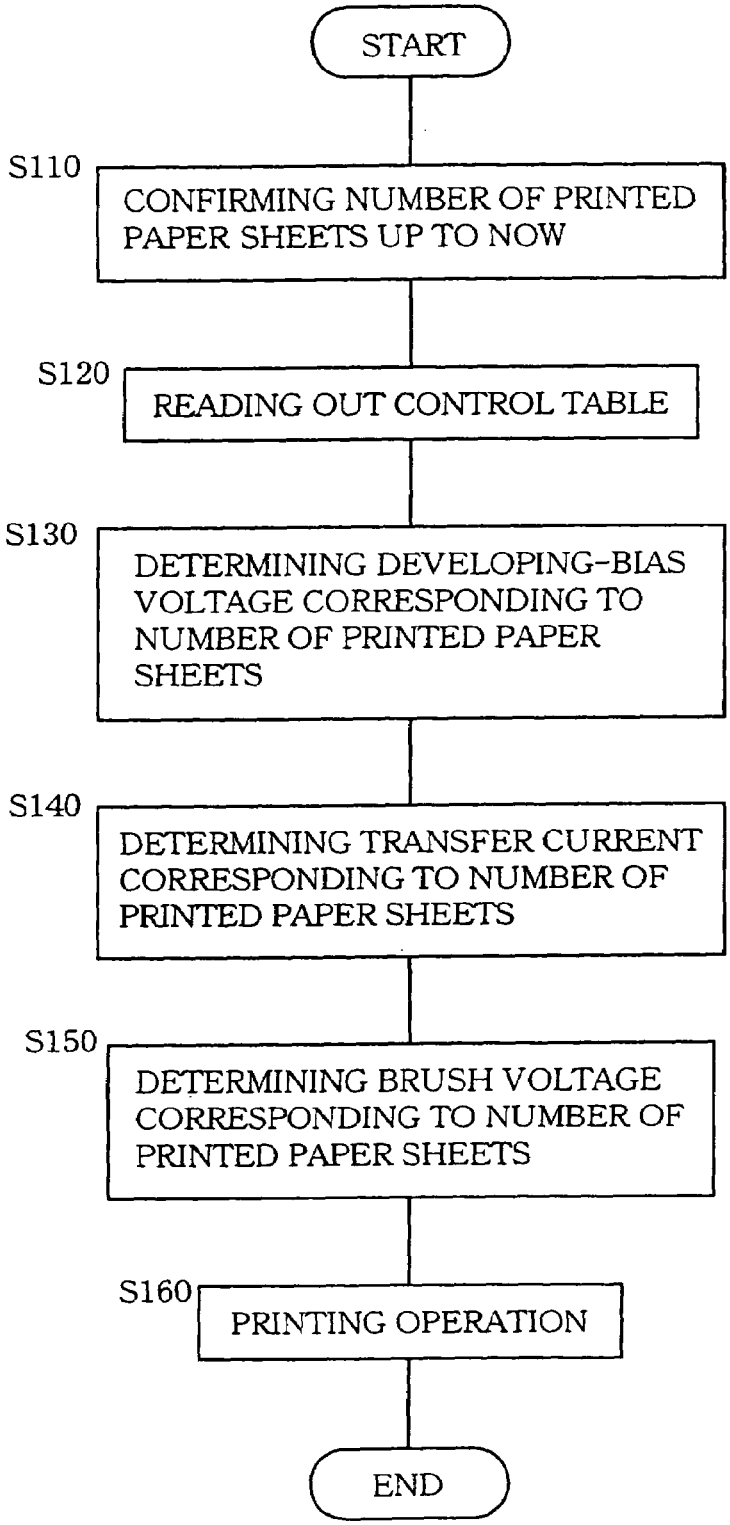
FIG. 4 is a flow chart representing a bias-determining operation executed by a CPU.

The CPU 101 of the laser printer 1 according to the present embodiment executes the bias-determining operation as shown in FIG. 4 and determines the developing-bias voltage, the transfer current, and the brush voltage which are suitable for the number of printed paper sheets. FIG. 4 is a flow chart representing the bias-determining operation executed by the CPU 101 of the laser printer 1. The controller and the paper-dust-removing-voltage changing device of the present invention are realized by the bias-determining operation executed by the CPU 101.

Upon starting of the bias-determining operation shown in FIG. 4, the CPU 101 initially, in S110, reads out a counted value stored in the counter 107 to confirm the number of printed paper sheets up to now. Then, based on the counted value read in S110, the CPU 101 reads out in S120, from the control table 105 stored in the ROM 103, the developing-bias voltage value, the transfer current value, and the brush-voltage value which correspond to the number of printed paper sheets (counted value).

Subsequently after the S120, the CPU 101 determines, in S130, the developing-bias voltage value read out in S120 as the control value of the developing-bias supplying portion 111, so that the developing-bias voltage corresponding to the control value is supplied by the developing-bias supplying portion 111 to the developing roller 57. Simultaneously, the CPU 102 determines, in S140, the transfer-current value read out in S120 as the control value of the transfer-forward-bias supplying portion 113, so that the transfer current corresponding to the control value is supplied form the transfer-forward-bias supplying portion 113 to the transfer roller 60.

Further, the CPU 101 determines, in S150, the brush-voltage value read out in S120 as the control value of the brush-voltage supplying portion 117, so that the brush-voltage corresponding to the control value is supplied by the brush-voltage supplying portion 117 to the cleaning brush 81.

Thereafter, the CPU 101 performs, in S160, a printing operation under the determined developing-bias voltage, transfer current, and brush voltage, so that the toner image is transferred to the paper sheet P in a known manner.

Figure 5A:
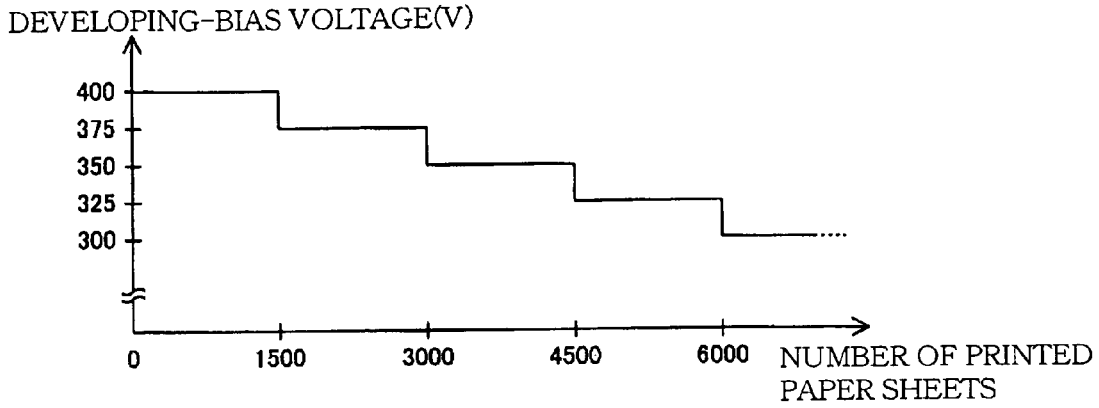
FIG. 5A is a graph showing a relationship between the number of printed paper sheets and the developing-bias voltage.
Figure 5B:
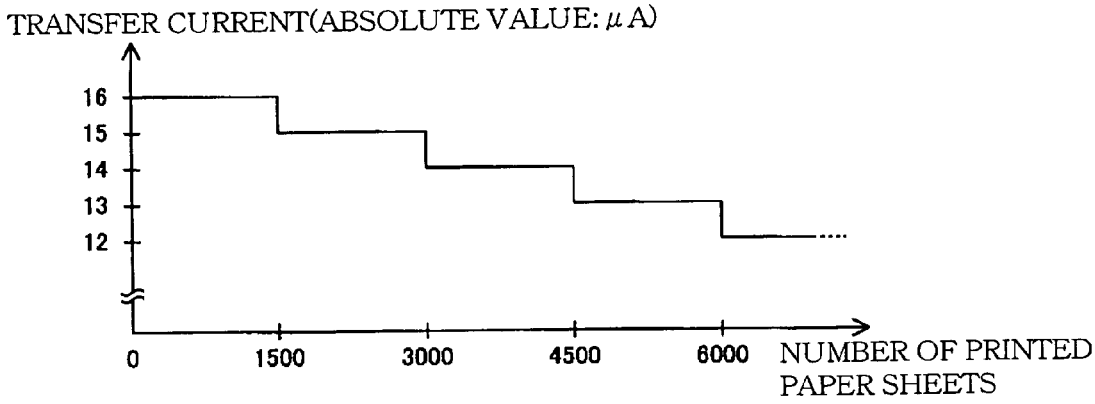
FIG. 5B is a graph showing a relationship between the number of printed paper sheets and the transfer current.
Figure 5C:
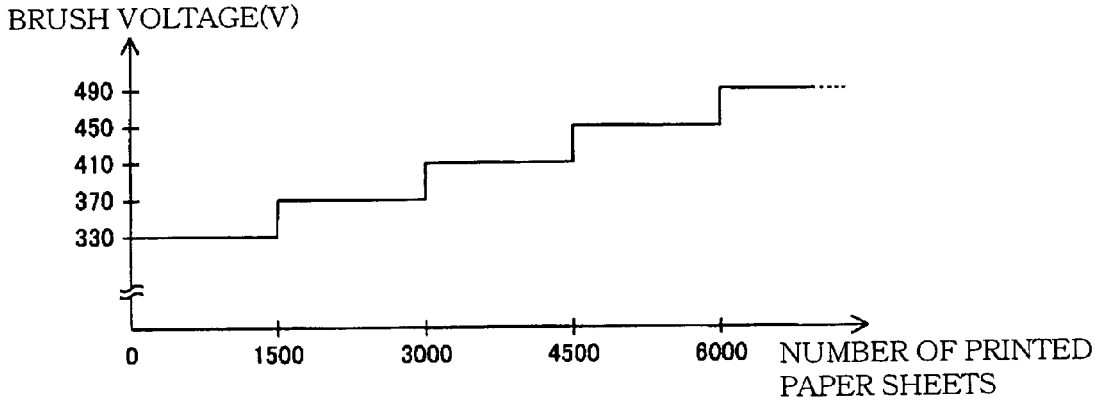
FIG. 5C is a graph showing a relationship between the number of printed paper sheets and the brush voltage.

In the present embodiment wherein the CPU 101 executes the bias-determining operation shown in FIG. 4 for each of the paper sheet to be printed, the developing-bias voltage, the transfer current, and the brush voltage are changed as shown in FIGS. 5A-5C with an increase in the number of printed paper sheets. FIG. 5A is a graph showing the relationship between the number of printed paper sheets and the developing-bias voltage supplied to the developing roller 57, FIG. 5B is a graph showing the relationship between the number of printed paper sheets and the transfer current supplied to the transfer roller 60, and FIG. 5C is a graph showing the relationship between the number of printed paper sheets and the brush voltage supplied to the cleaning brush 81.

As shown in FIGS. 5A-5C, in the present embodiment, every time when the number of printed paper sheets exceeds 1,500, the developing-bias voltage and the transfer current (absolute value) are made smaller by respective predetermined amounts and the brush voltage is made larger by a predetermined amount. In other words, by executing the bias-determining operation shown in FIG. 4, the CPU 101 controls the developing-bias voltage value, the transfer current value, and the brush voltage value such that the developing-bias voltage value decreases with the increase in the number of printed paper sheets, the transfer current value (absolute value) decreases with the decrease in the developing-bias voltage value, and the brush voltage value increases with the decrease in the transfer current value (absolute value).

Described more specifically, the control table 105 described above is prepared in the following manner: Initially, in order to determine the developing-bias voltage values respectively suitable for predetermined numbers of printed paper sheets, a printing operation was carried out using a test machine of the laser printer 1 in the manner described above. Described in detail, with the developing-bias voltage value, the transfer current value, and the brush-voltage value being fixed, the toner image was transferred to paper sheets P so as to obtain a sample of a printed image. The concentration was measured for the obtained sample of printed image by using a transmission densitometer. The printing operation was repeated plural times to obtain a plurality of samples of printed image while changing the developing-bias voltage, and the measurement was carried out for each sample, whereby the developing-bias voltage values at which the concentration of samples of printed image were approximately constant irrespective of the number of printed paper sheets were determined respectively for the predetermined numbers of printed paper sheets (for every 1,500 sheets in the present embodiment).

After the developing-bias voltage values at which the concentration of the samples of printed image was approximately constant were determined as described above, the printing operation was carried out under the respective developing-bias voltages values so as to form black solid images, and the surface potential of the photosensitive drum 20 after the image transfer was measured at a portion thereof contacting the cleaning brush 81. If the measured value is not greater than zero, it is conceivable that the charging polarity of the toner remaining on the surface of the photosensitive drum 20 after the image transfer was reversed, namely, changed into the negative polarity and is in a state in which the remaining toner is likely to adhere to the cleaning brush 81. In view of this, there are sought transfer-current values which do not cause the surface potential of the photosensitive drum 20 measured at the respective developing-bias voltage values to be zero or smaller.

Described more specifically, the transfer-current values suitable for the respective developing-bias voltage values are determined such that the surface potential of the photosensitive drum 20 after the image transfer does not become not greater than 50 V by taking into account the resistance value of the transfer roller 60 and variations of a transfer current depending upon the kind of the paper. Accordingly, the CPU 101 is capable of controlling the transfer-current value such that the polarity of the remaining toner adhering to the photosensitive drum 20 is not reversed.

After the transfer-current values are determined as described above, the brush-voltage values suitable for the respective transfer-current values are determined. The laser printer 1 of the present embodiment is not equipped with, on the downstream side of the transfer position, any erasing device such as an erase lamp for erasing the surface potential of the photosensitive drum 20. Accordingly, when the transfer-current value is changed, the surface potential of the photosensitive drum 20 at a portion thereof contacting the cleaning brush 81 is changed, and the optimum value of the brush voltage for effectively removing the negatively charged paper dust by the cleaning brush 81 (in other words, the optimum value of the surface potential of the cleaning brush 81) is accordingly changed. Described in detail, when the transfer-current value becomes smaller, the surface potential of the unexposed portion of the photosensitive drum 20 contacting the cleaning brush 81 becomes higher than that before the transfer-current value becomes smaller, so that the optimum value of the brush voltage becomes higher with the decrease in the transfer-current value.

It is known from experience of the inventor of the present invention that the voltage value to be applied to the cleaning brush 81 (in other words, the potential of the cleaning brush 81) is preferably made larger by about 100-200V than the surface potential of the photosensitive drum 20. In view of this, in the present embodiment, the surface potential of the unexposed portion of the photosensitive drum 20 contacting the cleaning brush 81 is measured for each of the transfer-current values determined as described above, and the voltage value to be supplied to the cleaning brash 81 (brush voltage) is determined to be equal to a value which is obtained by adding 125V to the surface potential value of the unexposed portion for each transfer-current value.

Thus, in the present embodiment, the control table 105 is prepared by obtaining a suitable relationship between the number of printed paper sheets and the developing-bias voltage, a suitable relationship between the developing-bias voltage and the transfer current, and a suitable relationship between the transfer current and the brush voltage, and the prepared control table 105 is stored in the ROM 103.

There has been described the structure of the laser printer 1. In the present embodiment, the control table 105 is prepared by finding out the transfer current suitable for the developing bias supplied to the developing roller 57. By the bias-determining operation, the CPU 101 reads out in S120 from the control table 105 the transfer-current value corresponding to the developing bias supplied to the developing roller 57, and determines in S140 the transfer-current value read out from the control table 105 in S120 as the control value of the transfer-forward-bias supplying portion 113. Thus, the CPU 101 is arranged to control the transfer current on the basis of the developing-bias value which is supplied by the developing-bias supplying portion 111 to the developing roller 57.

Further, in the present embodiment, the developing bias at which the quality of the printed image is uniform irrespective of an increase in the number of the printed paper sheets is obtained by tests or experiments, and the control table 105 is prepared by taking into account the results of the tests. The CPU 101 is arranged to control the developing bias and the transfer current on the basis of the number of printed paper sheets by determining, based on the control table 105, the developing-bias voltage value corresponding to the number of printed paper sheets as the control value of the developing-bias supplying portion 111.

Figure 6:
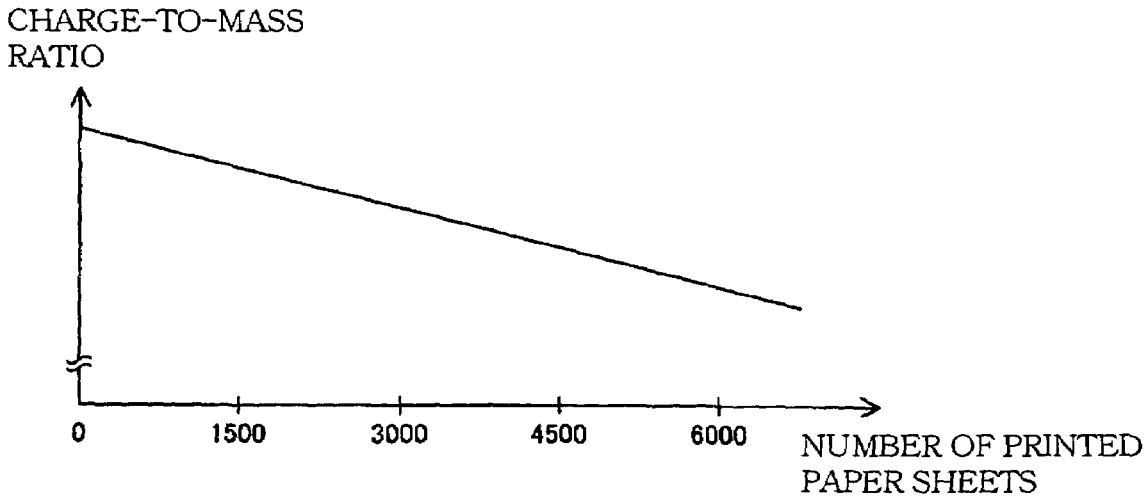
FIG. 6 is a graph showing a relationship between the number of printed paper sheets and the charge-to-mass ratio.

Described more specifically, since the charge-to-mass ratio of the toner decreases depending upon the number of the printed paper sheets as shown in FIG. 6, the CPU 101 is arranged to control the developing bias to decease with an increase in the number of the printed paper sheets, whereby the concentration of the printed image is made constant irrespective of the number of printed paper sheets. Further, transfer-current value is arranged to decrease with the decrease in the developing-bias value, whereby the transfer current is prevented from being excessively supplied to the transfer roller 60, thereby preventing the remaining toner after the image transfer from being negatively charged and accordingly adhering to the cleaning brush 81.

According to the present embodiment, the laser printer 1 exhibits a high performance and is capable of stably forming the high-quality image on the paper sheet P irrespective of the number of printed paper sheets. In addition, the present embodiment is effective to prevent the rate of collection or recovery of the remaining toner by the developing unit 50 after the image transfer from being deteriorated due to adhesion, to the cleaning brush 81, of the remaining toner after the image transfer whose polarity has been reversed into negative polarity by the image transfer.

The ion-conductive foamed elastic body deteriorates with an increase in the total amount of electric current flowing therethrough, and its resistance value accordingly increases. In the present embodiment, the transfer current is not wastefully supplied to the transfer roller 60, so that the service life of the transfer roller 60 can be effectively increased. In addition, the power consumption of the laser printer 1 can be reduced.

Further, in the present embodiment, the brush voltage applied to the cleaning brush 81 by the brush-voltage supplying portion 117 is arranged to be changed on the basis of the transfer-current value according to the bias-determining operation executed by the CPU 101, in order to comply or deal with the change in the surface potential of the unexposed portion of the photosensitive drum 20 which arises from the change in the transfer current. Accordingly, the present embodiment is effective to prevent deterioration of the paper-dust removal capability due to an excessively small brush voltage and deterioration of the cleaning brush 81 and the photosensitive drum 20 due to application of an excessively large brush voltage. Therefore, only the paper dust can be selectively removed from the photosensitive drum 20 with high efficiency and the power consumption of the laser printer 1 can be reduced.

While the preferred embodiment of the present invention has been described above, for illustrative purpose only, it is to be understood that the invention is not limited to the details of the illustrated embodiment, but may be embodied with various changes, modifications and improvements, which may occur to those skilled in the art, without departing from the spirit and scope of the invention.

In the illustrated embodiment, the laser printer 1 is arranged such that the respective values of the developing bias, transfer current, and brush voltage are determined on the basis of the control table 105. The laser printer 1 may be arranged otherwise. For instance, there may be stored, in the ROM 103, an arithmetic expression(s) for obtaining the optimum developing-bias value on the basis of the number of printed paper sheets, an arithmetic expression(s) for obtaining the optimum transfer-current value on the basis of the developing-bias value, and an arithmetic expression(s) for obtaining the optimum brush-voltage value on the basis of the transfer-current value. The developing bias, the transfer current, and the brush voltage may be determined from the respective arithmetic expressions.

In the illustrated embodiment, the respective values of the developing bias, transfer current, and brush voltage are changed on the basis of the number of printed paper sheets. In place of the number of printed paper sheets, the total operation amount of the laser printer 1, the rotating number of the developing roller 57, etc., may be used to determine those values.

In the illustrated embodiment, the cleaning device 80 equipped with the cleaning brush 81 is arranged to remove the paper dust. In place of the cleaning device 80 described above, there may be used other known cleaning devices such as those arranged to remove the paper dust by non-woven fabric.

What is claimed is:

1. An image forming apparatus comprising:

a developing device that develops an electrostatic latent image formed on an image bearing body into a visible image by using a charged developer, so as to form a developer image on the image bearing body;

a developing-bias supplying device that supplies, to the developing device, a developing bias necessary for developing the electrostatic latent image into the visible image;

a transfer device that transfers the developer image formed on the image bearing body onto a recording medium;

a transfer-bias supplying device that supplies, to the transfer device, a transfer bias necessary for transferring the developer image onto the recording medium; and a controller that carries out an operation-amount-dependent developing-and-transfer-bias control for controlling the developing bias supplied by the developing-bias supplying device to the developing device and the transfer bias supplied by the transfer-bias supplying device to the transfer device, on the basis of an operation amount of the image forming apparatus, wherein the controller is arranged such that the developing bias supplied by the developing-bias supplying device to the developing device decreases with an increase in the operation amount of the image forming apparatus.

2. The image forming apparatus according to claim 1, wherein the developing-bias supplying device is arranged such that the developing bias supplied to the developing device is variable.

3. The image forming apparatus according to claim 1, further comprising an operation-amount measuring device that measures the operation amount of the image forming apparatus, the controller being arranged to carry out the operation-amount-dependent developing-and-transfer-bias control on the basis of the operation amount of the image forming apparatus measured by the operation-amount measuring device.

4. The image forming apparatus according to claim 1, wherein the controller is arranged such that the transfer bias supplied by the transfer-bias supplying device to the transfer device decreases with a decrease in the developing bias.

5. The image forming apparatus according to claim 1, which is arranged such that the developer remaining on the image bearing body after the developer image has been transferred to the recording medium by the transfer device is collected by the developing device, the controller being arranged to control the transfer bias supplied by the transfer-bias supplying device to the transfer device such that polarity of the developer adhering to the image bearing body is not reversed.

6. The image forming apparatus according to claim 1, wherein the transfer device is an ion-conductive transfer roller that is arranged to transfer, upon receiving the transfer bias, the developer image formed on the image bearing body to the recoding medium passing between the image bearing body and transfer roller.

7. The image forming apparatus according to claim 1, which is arranged to transfer the developer image to a recording paper as the recording medium and which further comprises:

a paper-dust removing device that removes paper dust adhered to the image bearing body when the developer image is transferred to the recording medium by the transfer device;

a paper-dust-removing-voltage supplying device that supplies, to the paper-dust removing device, a voltage for removing the paper dust from the image bearing body; and a paper-dust-removing-voltage changing device that changes the paper-dust-removing voltage supplied by the paper-dust-removing-voltage supplying device to the paper-dust removing device, on the basis of the transfer bias supplied by the transfer-bias supplying device to the transfer device.

8. The image forming apparatus according to claim 7, wherein the paper-dust removing device comprises any one of a brush and a non-woven fabric both of which have an electrical conductivity and attract the paper dust adhering to the image bearing body, upon receiving the paper-dust-removing voltage supplied by the paper-dust-removing-voltage supplying device.

9. The image forming apparatus according to claim 7, wherein the developer is a positively charged toner.

10. An image forming apparatus comprising:

a developing device that develops an electrostatic latent image formed on an image bearing body into a visible image by using a charged developer, so as to form a developer image on the image bearing body;

a developing-bias supplying device that supplies, to the developing device, a developing bias necessary for developing the electrostatic latent image into the visible image;

a transfer device that transfers the developer image formed on the image bearing body onto a recording medium;

a transfer-bias supplying device that supplies, to the transfer device, a transfer bias necessary for transferring the developer image onto the recording medium; and a controller that carries out an operation-amount-dependent developing bias control for controlling the developing bias supplied by the developing-bias supplying device to the developing device on the basis of an operation amount of the image forming apparatus, and also carries out a developing-bias-dependent transfer-bias control for controlling the transfer bias supplied by the transfer-bias supplying device to the transfer device, on the basis of the developing bias supplied by the developing-bias supplying device to the developing device.

11. The image forming apparatus according to claim 10, wherein the developing-bias supplying device is arranged such that the developing bias supplied to the developing device is variable.

12. The image forming apparatus according to claim 10, further comprising an operation-amount measuring device that measures the operation amount of the image forming apparatus, the controller being arranged to carry out the operation-amount-dependent developing-and-transfer-bias control on the basis of the operation amount of the image forming apparatus measured by the operation-amount measuring device.

13. The image forming apparatus according to claim 10, wherein the controller is arranged such that the developing bias supplied by the developing-bias supplying device to the developing device decreases with an increase in the operation amount of the image forming apparatus.

14. The image forming apparatus according to claim 10, wherein the controller is arranged such that the transfer bias supplied by the transfer-bias supplying device to the transfer device decreases with a decrease in the developing bias.

15. The image forming apparatus according to claim 10, which is arranged such that the developer remaining on the image bearing body after the developer image has been transferred to the recording medium by the transfer device is collected by the developing device, the controller being arranged to control the transfer bias supplied by the transfer-bias supplying device to the transfer device such that polarity of the developer adhering to the image bearing body is not reversed.

16. The image forming apparatus according to claim 10, wherein the transfer device is an ion-conductive transfer roller that is arranged to transfer, upon receiving the transfer bias, the developer image formed on the image bearing body to the recording medium passing between the image bearing body and transfer roller.

17. The image forming apparatus according to claim 10, which is arranged to transfer the developer image to a recording paper as the recording medium and which further comprises:

a paper-dust removing device that removes paper dust adhered to the image bearing body when the developer image is transferred to the recording medium by the transfer device;

a paper-dust-removing-voltage supplying device that supplies, to the paper-dust removing device, a voltage for removing the paper dust from the image bearing body; and a paper-dust-removing-voltage changing device that changes the paper-dust-removing voltage supplied by the paper-dust-removing-voltage supplying device to the paper-dust removing device, on the basis of the transfer bias supplied by the transfer-bias supplying device to the transfer device.

18. The image forming apparatus according to claim 17, wherein the paper-dust removing device comprises any one of a brush and a non-woven fabric both of which have an electrical conductivity and attract the paper dust adhering to the image bearing body, upon receiving the paper-dust-removing voltage supplied by the paper-dust-removing-voltage supplying device.

19. The image forming apparatus according to claim 17, wherein the developer is a positively charged toner.

* * * * *